US006560943B1

(12) United States Patent
Leek et al.

(10) Patent No.: US 6,560,943 B1
(45) Date of Patent: May 13, 2003

(54) LATERAL TRUSS ANCHOR

(75) Inventors: William F. Leek, Carmel, CA (US); Todd W. Stuart, Oakland, CA (US)

(73) Assignee: Simpson Strong-Tie Company, Inc., Dublin, CA (US)

( * ) Notice: Subject to any disclaimer, the term of this patent is extended or adjusted under 35 U.S.C. 154(b) by 0 days.

(21) Appl. No.: 09/461,687

(22) Filed: Dec. 14, 1999

(51) Int. Cl.[7] ..... E02D 27/00

(52) U.S. Cl. ..... 52/715; 52/712; 52/295; 52/698

(58) Field of Search ..... 52/698, 699, 700, 52/703, 707, 712, 713, 714, 715, 295, 91.2, 92.1, 92.2; 14/14

(56) References Cited

U.S. PATENT DOCUMENTS

| | | | | |
|---|---|---|---|---|
| 1,423,991 A | | 7/1922 | Brooks | |
| 1,945,925 A | | 2/1934 | Stiefel | |
| 2,013,101 A | | 9/1935 | Inglee | |
| 2,182,579 A | | 12/1939 | Bolton et al. | |
| 2,191,979 A | | 2/1940 | Bierbach | |
| 2,390,379 A | | 12/1945 | Martin | |
| 2,467,115 A | * | 4/1949 | Duggan | 52/289 |
| 2,947,119 A | * | 8/1960 | Puckett, Jr. | 52/370 |
| 3,000,145 A | | 9/1961 | Fine | |
| 3,889,441 A | | 6/1975 | Fortine | |
| 3,998,026 A | | 12/1976 | Allen | |
| 4,096,677 A | | 6/1978 | Gilb | |
| 4,199,908 A | | 4/1980 | Teeters | |
| 4,329,826 A | | 5/1982 | Flogaus et al. | |
| 4,404,781 A | | 9/1983 | Gilb | |
| 4,410,294 A | | 10/1983 | Gilb | |
| 4,413,456 A | | 11/1983 | Gilb | |
| 4,449,335 A | | 5/1984 | Fahey | |

(List continued on next page.)

OTHER PUBLICATIONS

Page 31 from Product Catalog for Hughes Manufacturing. Published at least as early as Dec. 27, 1994. Hughes Manufacturing is located in Florida.

Page 27 from Product Catalog for Southeastern Metals. Published at least as early as Dec. 27, 1994.

Page 26 from Product Catalog for Southeastern Metals. Published at least as early as Dec. 27, 1994.

Connectors for the Plated Truss Industry, Product & Instruction Manual, Catalog C–PT94–1. Copyright 1993. Simpson Strong–Tie Company, Inc. California. Cover page and pp. 23,25 and 28.

Product Catalog from Hughes Manufacturing. Published at least as early as 1997. Hughes Manufacturing, Inc. is located in Florida. Cover page and pp. 6,7,9,21,34,35,36, 41 & 42.

Connectors for Wood Construction, Product & Instruction Manual, Catalog C–94H–1. Copyright 1993. Simpson Strong–Tie Company, Inc. California. Cover page and pp. 8,9,12,17,18,19,22,23 & 24.

*Primary Examiner*—Carl D. Friedman
*Assistant Examiner*—Basil Katcheves
(74) *Attorney, Agent, or Firm*—James R. Cypher; Charles R. Cypher

(57) ABSTRACT

A connection is provided that consists of a cementitious or masonry member, a structural member supported by the cementitious member and a connector attaching the structural member to the cementitious member. The connector is partially embedded in the cementitious member. The connector consists of a substantially planar main body and first and second anchoring legs. The planar main body is divided into an upper attachment portion which protrudes from the cementitious member and a lower embedment portion which is embedded in the cementitious member. The first anchoring leg is attached to the body and is substantially embedded in the cementitious member. The second anchoring leg is spaced apart from the first anchoring leg and is substantially embedded in the cementitious member.

20 Claims, 6 Drawing Sheets

U.S. PATENT DOCUMENTS

| | | | | | |
|---|---|---|---|---|---|
| D278,028 | S | | 3/1985 | Fleishman | |
| 4,527,375 | A | | 7/1985 | Braginetz | |
| 4,910,934 | A | | 3/1990 | Hennings | |
| 4,920,725 | A | * | 5/1990 | Gore | 52/702 |
| 4,924,648 | A | | 5/1990 | Gilb et al. | |
| 4,932,173 | A | | 6/1990 | Commins | |
| 4,995,206 | A | | 2/1991 | Colonias et al. | |
| 5,109,646 | A | | 5/1992 | Colonias et al. | |
| 5,150,553 | A | | 9/1992 | Commins et al. | |
| 5,253,465 | A | * | 10/1993 | Gilb | 52/643 |
| 5,307,603 | A | * | 5/1994 | Chiodo | 52/698 |
| 5,335,469 | A | | 8/1994 | Stuart | |
| 5,335,470 | A | * | 8/1994 | Alvarez | 52/699 |
| 5,357,721 | A | | 10/1994 | Alvarez | |
| 5,375,384 | A | * | 12/1994 | Wolfson | 52/295 |
| 5,380,115 | A | | 1/1995 | Colonias | |
| 5,442,887 | A | * | 8/1995 | Welsh | 52/713 |
| 5,595,031 | A | | 1/1997 | Commins | |
| 5,699,639 | A | * | 12/1997 | Fernandez | 52/707 |
| 5,813,182 | A | | 9/1998 | Commins | |

* cited by examiner

LATERAL TRUSS ANCHOR

BACKGROUND OF THE INVENTION

The present invention relates generally to the field of anchoring devices for securing structural building members together, and more specifically to an anchoring device for securing a truss to the top of a wall.

There is a wide variety of anchoring devices related to the present invention. Patented methods of securing trusses directly to cementitious walls included: U.S. Pat. No. 5,307,603, granted to Daniel J. Chiodo; U.S. Pat. No. 2,947,119, granted to L. P. Puckett Jr., and U.S. Pat. No. 2,467,115, granted to R. W. Dugan.

The present invention comprises a unique connection between a truss and a masonry or cementitious wall that is simple to construct and economical to use.

SUMMARY OF THE INVENTION

It is an object of the present invention to provide a unique connection between a truss and a masonry wall.

It is a further object of the present invention to provide a connector used in such a connection that will not interfere with most reinforcing members placed in the masonry members.

It is a further object of the present invention to provide a relatively stiff connection between the masonry member and the truss. This is accomplished by providing the connector with a planar main body portion that is both relatively wide and relatively tall, and is substantially embedded into the masonry member.

It is a further object of the present invention to provide a strong connection between the connector and the masonry member. This is done by a number of different means, including: providing the connector with a plurality of anchoring legs in addition to the embedded portion of the main body; spacing the anchoring legs apart from each other; spacing the anchoring legs away from the embedded portion of the main body; and providing the legs and main body with basal feet at their ends.

It is a further object of the present invention to design a connection that is simple to construct. This is accomplished in part by using common fasteners which are readily available to fasten the upper portion of the main body to the truss.

It is a further object of the present invention to provide a connector that is easy to manufacture. This is accomplished in the design of the preferred embodiment of the connector which is made from a single piece of sheet metal that can be completely formed on a progressive die press, according to methods well known in the industry.

A connection is provided that consists of a cementitious or masonry member, a structural member, and ac connector attaching the structural member to the cementitious member. The connector is partially embedded in the cementitious member. The connector consists of a substantially planar main body and first and second anchoring legs. The planar main body is divided into an upper attachment portion which protrudes from the cementitious member and a lower embedment portion which is embedded in the cementitious member. The first anchoring leg is attached to the main body and is substantially embedded in the cementitious member. The second anchoring leg is spaced apart from the first anchoring leg and is substantially embedded in the cementitious member.

DETAILED DESCRIPTION OF THE PREFERRED EMBODIMENT

Figure 7:
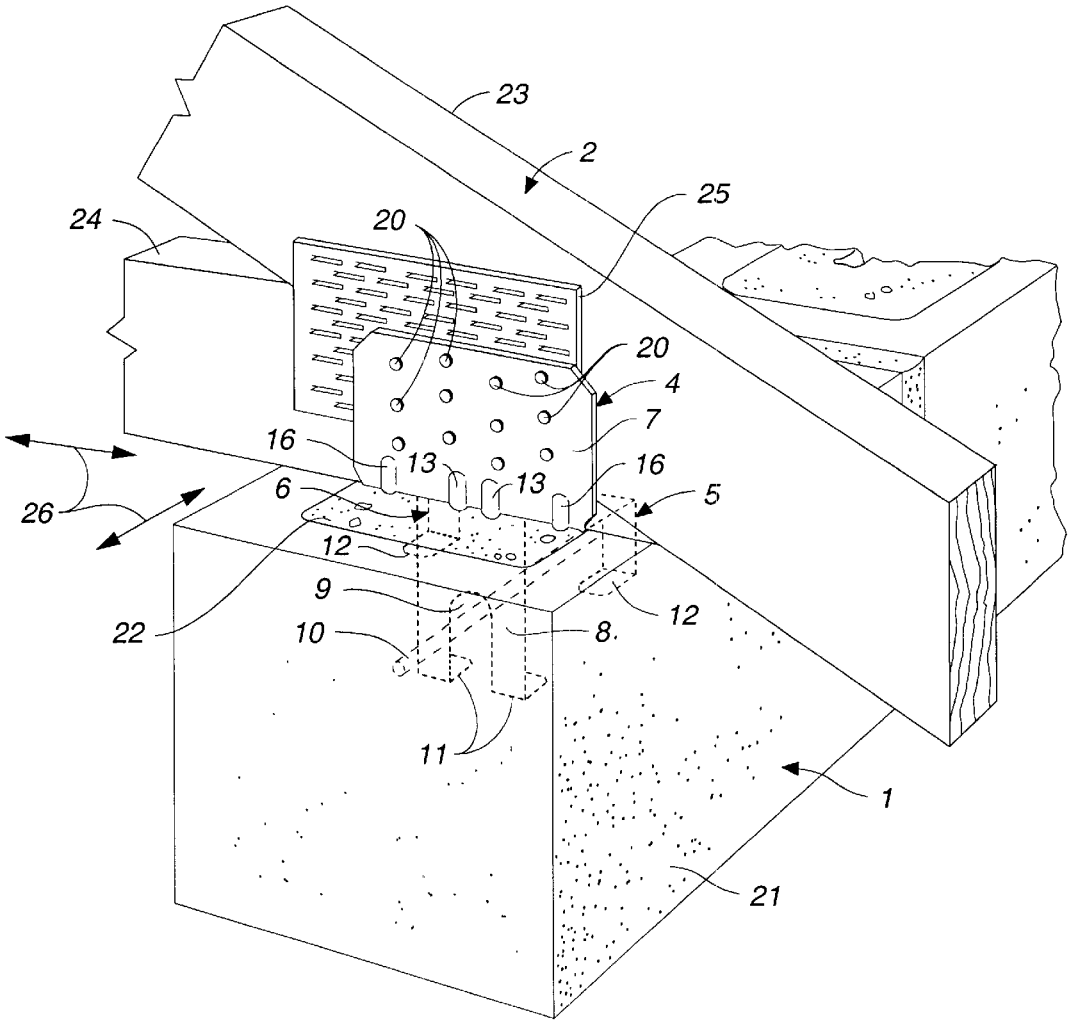
FIG. 7 is a perspective view of preferred embodiment of the connection of the present invention between a truss and a wall made from concrete block and concrete.

As shown in FIG. 7, in the preferred embodiment a connection is provided that consists of a cementitious or masonry member 1, a structural member 2 supported by the cementitious member 1 and a connector 3 attaching the structural member 2 to the cementitious member 1. The connector 3 is partially embedded in the cementitious member 1. The connector 3 consists of a substantially planar main body 4 and first and second anchoring legs 5 and 6 distinct from the main body 4. The planar main body 4 has an upper attachment portion 7 which protrudes from the cementitious member 1 and a lower embedment portion 8 which is embedded in the cementitious member 1. The first anchoring leg 5 is attached to the main body 4 and is substantially embedded in the cementitious member 1. The second anchoring leg 6, spaced apart from the first anchoring leg 5, is also attached to the main body 4 and substantially embedded in the cementitious member 1. Preferably, the first and second anchoring legs 5 and 6 are not connected, except through said main body 4.

Figure 3:
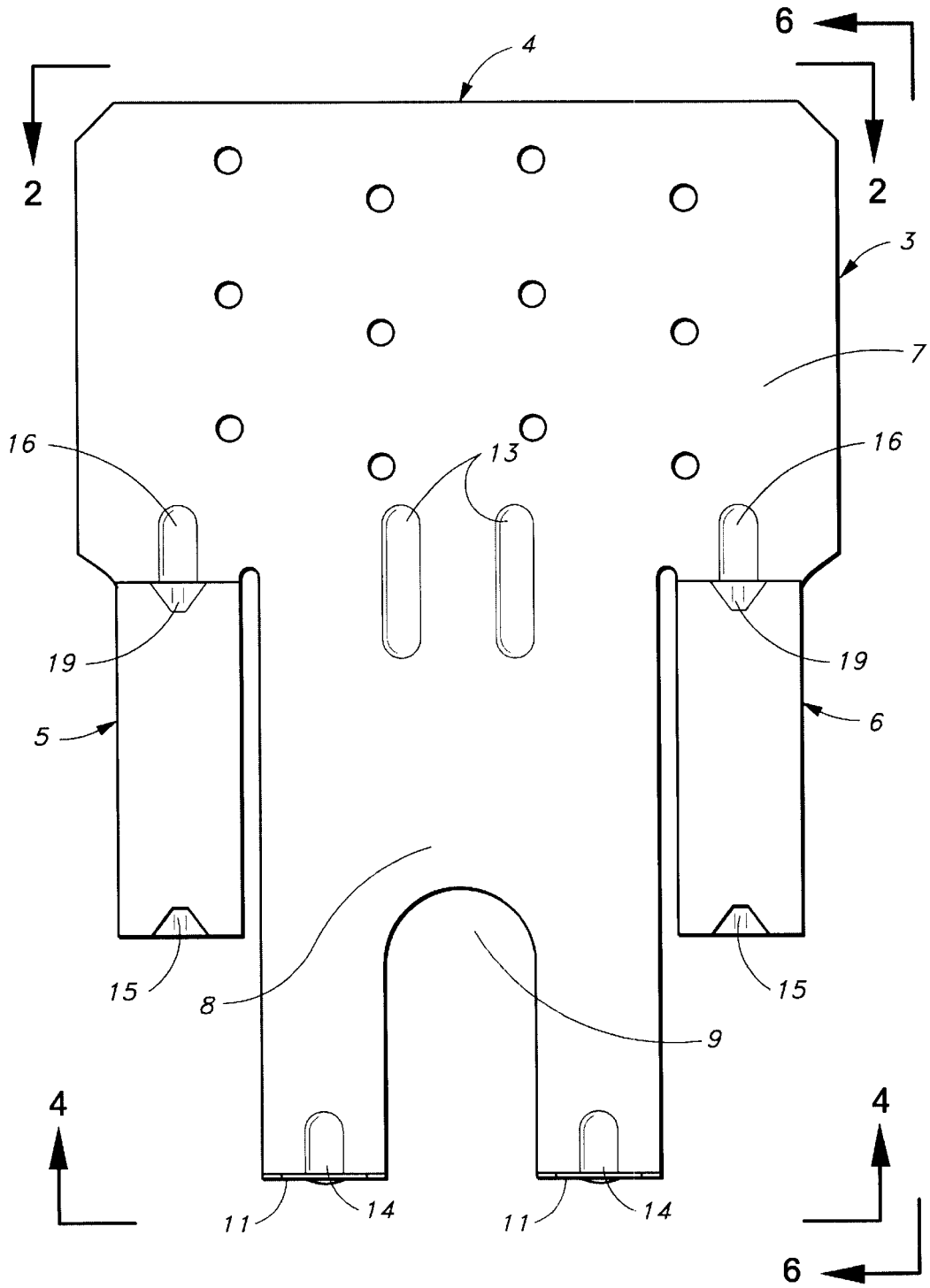
FIG. 3 is a front view of the connector of the present invention taken along line 3—3 of FIG. 2.
Figure 5:
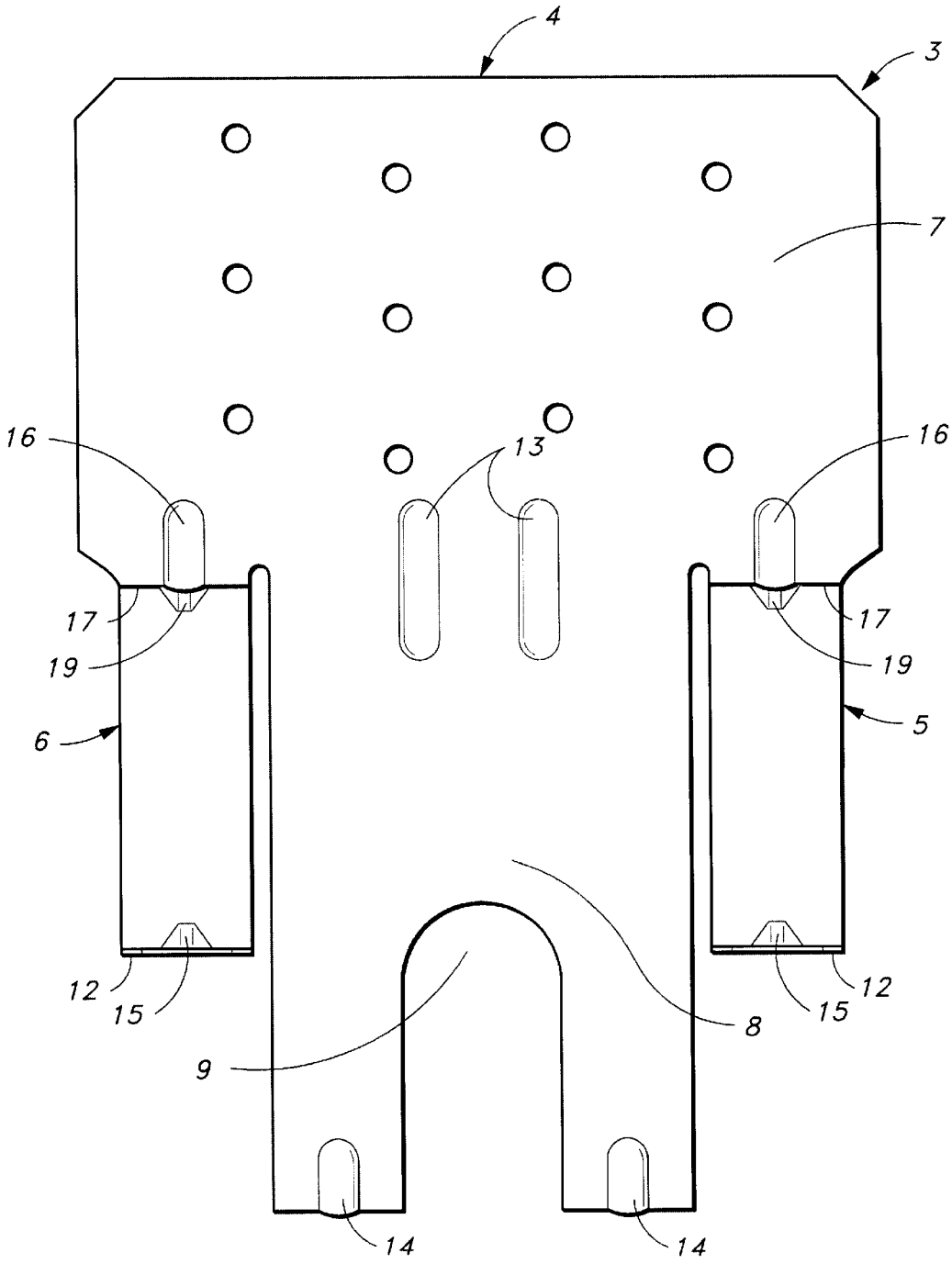
FIG. 5 is a back view of the connector of the present invention taken along line 5—5 of FIG. 6.

As shown in FIG. 3, in the preferred embodiment the lower embedment portion 8 of the planar main body 4 is substantially wider than the first and second anchoring legs 5 and 6. As is also shown in FIG. 3, in the preferred embodiment the lower embedment portion 8 of the planar main body 4 is formed with a downwardly depending notch 9. This notch 9 is primarily designed to allow the connector 3 to be deeply set in the cementitious or masonry member 1 without interfering with any centrally located reinforcing members or rebar 10, if used. See FIG. 7.

Figure 1:
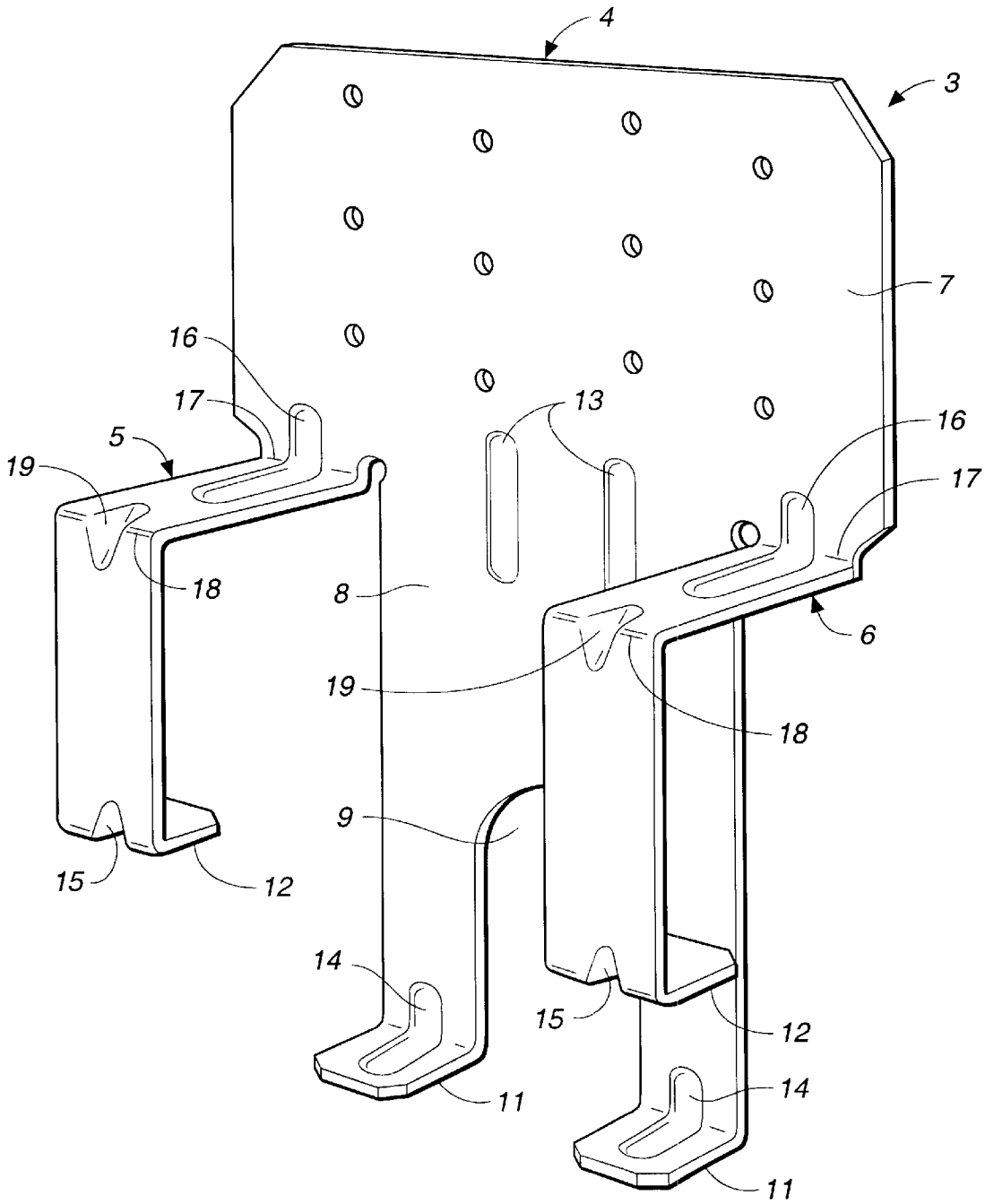
FIG. 1 is a perspective view of the preferred embodiment of the connector of the present invention.
Figure 2:
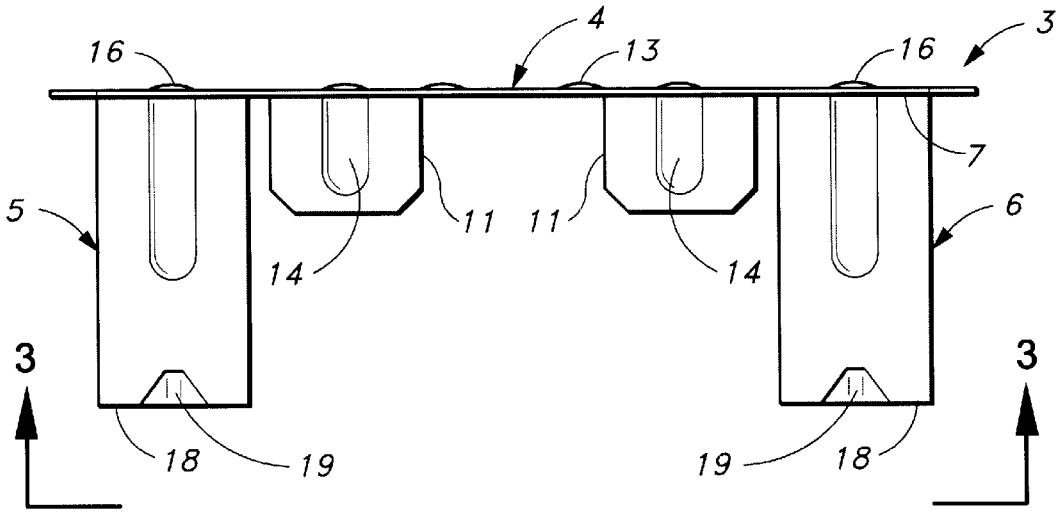
FIG. 2 is a top view of the connector of the present invention taken along line 2—2 of FIG. 3.
Figure 4:
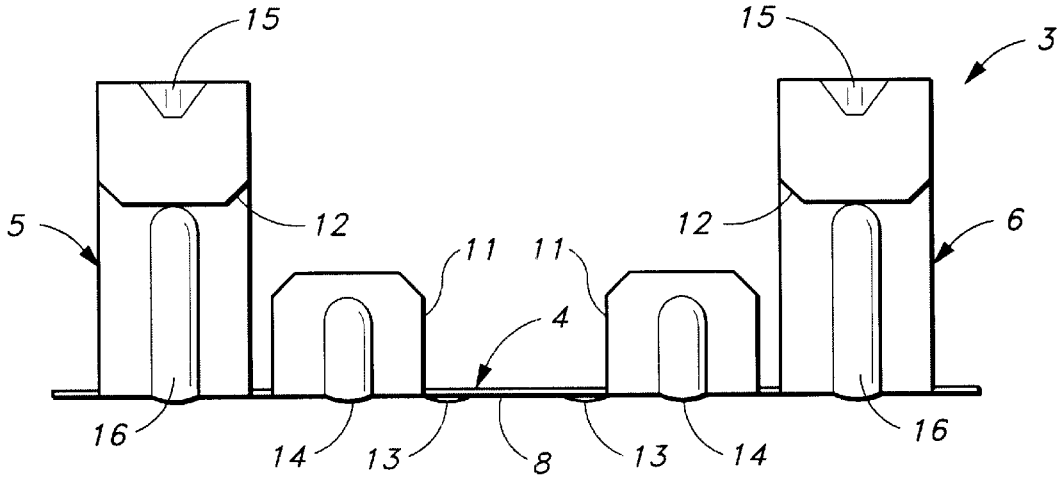
FIG. 4 is bottom view of the connector of the present invention taken along line 4—4 of FIG. 3.

As is shown best in FIG. 1, in the preferred embodiment the lower embedment portion 8 of the planar main body 4 has attached to it two basal feet 11 on either side of the notch 10. The basal feet 11 consist of lateral flanges, extending from the lower embedment portion 8.

As is shown best in FIG. 1, preferably the first and second anchoring legs 5 and 6 have lower ends that are formed with basal feet 12, also consisting of lateral flanges.

Figure 6:
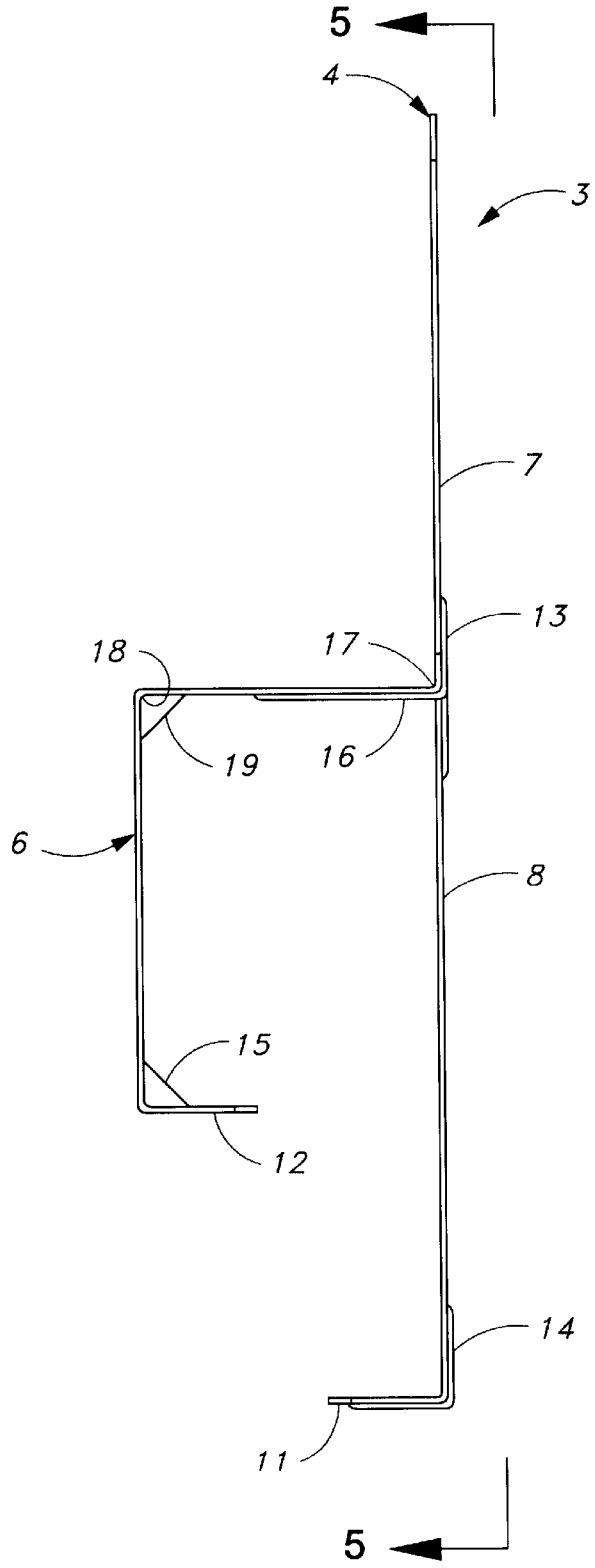
FIG. 6 is side view of the connector of the present invention taken along line 6—6 of FIG. 3.

As is shown best in FIGS. 1 and 6, in the preferred embodiment the first and second anchoring legs 5 and 6 are attached to the planar main body 4 and are bent out of the plane of the main body 4.

As is shown in FIG. 1, the connector 3 is formed with embossed portions 13 in the planar main body 4 to strengthen the connector 3. As is also shown in FIG. 1, embossments 14 are also formed in the basal feet 11 of the lower embedment portion 8, with these embossments 14 running partially up into the lower embedment portion 8 on either side of the notch 9.

As is best shown in FIGS. 1, 3 and 6, in the preferred embodiment the first and second anchoring legs 5 and 6 have lower ends that are formed with basal feet 12, consisting of lateral flanges, creating interfaces between the lateral flanges and the remainder of the first and the second anchoring legs 5 and 6, and at these interfaces, gussets 15 are formed to strengthen the anchoring legs 5 and 6.

As is best shown in FIG. 3, in the preferred embodiment a substantial portion of the lower embedment portion 8 of said connector 3 is at least fifty percent as wide as the upper attachment portion 7 of the connector 3.

As is also shown in FIG. 1, in the preferred embodiment two embossments 16 are formed in the connector 3 that start in the planar main body 4 and run into the first and second anchoring legs 5 and 6.

As is best shown in FIGS. 1 and 6, the first and second anchoring legs 5 and 6 are attached to the planar main body. Preferably, these first and second anchoring legs 5 and 6 are bent out of the plane of the main body 4 at a first right angle bend 17, and then bent downwardly at a second right angle bend 18 so that portions of the first and second anchoring legs 5 and 6 lie parallel to the planar main body 4.

As is also best shown in FIGS. 1 and 6, in the preferred embodiment, at the second right angle bend 18 where the first and second anchoring legs and 6 are bent downwardly so that portions of said first and second anchoring legs 5 and 6 lie parallel to said planar main body 4, gussets 19 are formed to strengthen said first and second anchoring legs 5 and 6.

In the preferred embodiment fasteners are used to connect the structural member 2 to the upper attachment portion 7 of the connector 3. As is shown in FIG. 7, these fasteners are preferably nails 20 when the structural member 2 is a nailable member such as wood. These fasteners can also be screws or rivets, for example.

As is shown in FIG. 7, in the preferred embodiment the cementitious member 1 is preferably a wall made from concrete blocks 21, with the cells or cavities in the concrete blocks 21 filled with grout or cement 22. The structural member 2 is preferably an open-webbed, wooden truss having top and bottom chords 23 and 24, with the members of the truss joined together by nail plates 25.

As is shown in FIG. 7, preferably the cementitious member 1 is the wall of a building made up of concrete blocks 21, at least some of which are filled with grout 22, cement or some other settable member, and the upper attachment portion 7 of the connector 3 is almost as wide as the cavity of the cement block 21 in which it embedded. The relevant width dimension of the rectangular cavity in the cement block 21 is the dimension that parallels the structural member or truss 2. As stated above, in the preferred embodiment the lower embedment portion 8 of the connector 3 has a substantial portion which is at least fifty percent as wide as the upper attachment portion 7 of the connector 3.

Double-headed arrows 26 in FIG. 7 represent forces that can be imposed on the structural member 2.

The connector is preferably made from 18 gauge ASTM Grade A-653 LS coated sheet steel with a yield strength of 28,000 psi and a tensile strength of 38,000 psi. It is protected from corrosion by G60 galvanizing.

The connection is preferably made by suspending the connector 3 in the cell or cavity of a cement block 21 at the proper elevation before the grout 22 is poured. Grout 22 is then poured in the blocks 20 and allowed to set. The structural member 2 is then placed on top of the cement block 21, and attached to the connector 3 by means of nails 20. The connector 3 can also be wet set in the grout 22, but this is not preferred.

We claim:

1. A connection, comprising:

a a cementitious member;

b a connector that is partially embedded in said cementitious member, comprising, 1 a substantially planar main body having an upper attachment portion which protrudes from said cementitious member and a lower embedment portion which is embedded in said cementitious member, 2 a first anchoring leg that is attached to said main body, spaced away from said lower embedment portion, and substantially embedded in said cementitious member, and 3 a second anchoring leg that is spaced apart from said first anchoring leg, attached to said main body, spaced away from said lower embedment portion, and substantially embedded in said cementitious member; and c a structural member connected to said upper attachment portion of said connector.

2. The connection of claim 1, wherein:

a. said cementitious member is a wall of a building, and b. said structural member is a truss.

3. The connection of claim 1, wherein:

said lower embedment portion of said planar main body is substantially wider than said first and second anchoring legs.

4. The connection of claim 1, wherein:

said lower embedment portion of said planar main body is formed with a downwardly depending notch.

5. The connection of claim 1, wherein:

said lower embedment portion of said planar main body has a lower end to which at least one basal foot is attached, consisting of a lateral flange extending from said lower embedment portion.

6. The connection of claim 1, wherein:

said first and second anchoring legs have lower ends that are formed with basal feet, consisting of lateral flanges.

7. The connection of claim 1, wherein:

said first and second anchoring legs are attached to said planar main body and bent away from said main body.

8. The connection of claim 1, wherein:

said connector is formed with embossed portions in said planar main body to strengthen said connector.

9. The connection of claim 1, wherein:

a. said lower embedment portion of said planar main body has a lower end to which at least one basal foot is attached, consisting of a lateral flange extending from said lower embedment portion; and b. an embossment runs from said basal foot partially up into said lower embedment portion.

10. The connection of claim 1, wherein:

a. said first anchoring leg has a lower end that is formed with a basal foot, consisting of lateral flange that divides said first anchoring leg into said lateral flange and the remaining portions of said first anchoring leg, creating an interface between said lateral flange and said remaining portions of said first anchoring leg; and b. a gusset is formed at said interface of said lateral flange with said remaining portions of said first anchoring leg.

11. The connection of claim 1, wherein:

a substantial portion of said lower embedment portion of said connector is at least fifty percent as wide as said upper attachment portion of said connector.

12. The connection of claim 1, wherein:

an embossment is formed in said connector that starts in said main planar main body and runs into said first anchoring leg.

13. The connection of claim 1, wherein:

said first and second anchoring legs are attached to said planar main body and said first and second anchoring legs are bent away from said main body at a first right angle bend, and then bent downwardly at a second right angle bend so that portions of said first and second anchoring legs lie parallel to said planar main body.

14. The connection of claim 13, wherein:

at said second right angle bend in said first anchoring leg a gusset is formed to strengthen said first anchoring leg.

15. The connection of claim 1, wherein:

fasteners are used to connect said structural member to said upper attachment portion of said connector.

16. The connection of claim 15, wherein:

said fasteners are nails.

17. The connection of claim 15, wherein:

said fasteners are screws.

18. The connection of claim 15, wherein:

said fasteners are rivets.

19. The connection of claim 1, wherein:

a. said cementitious member is a wall of a building made up of concrete blocks, having cavities, and at least some of said cavities are filled with grout, and b. said upper attachment portion of said connector is substantially as wide as said cavities in said cement blocks and said-lower embedment portion of said connector has a substantial portion which is at least fifty percent as wide as said upper attachment portion of said connector.

20. The connection of claim 1, wherein:

said lower embedment portion of said planar main body has a lower end to which two or more basal feet are attached, consisting of lateral flanges extending from said lower embedment portion.

* * * * *

UNITED STATES PATENT AND TRADEMARK OFFICE

CERTIFICATE OF CORRECTION

PATENT NO. : 6,560,943 B1 
DATED : May 13, 2003
INVENTOR(S) : William F. Leek and Todd W. Stuart It is certified that error appears in the above-identified patent and that said Letters Patent is hereby corrected as shown below:

Column 1,
Line 51, replace “ac” with -- a --.

Column 3,
Line 23, replace “legs and 6 are” with -- legs 5 and 6 are --.

Signed and Sealed this

Eighth Day of June, 2004

JON W. DUDAS
*Acting Director of the United States Patent and Trademark Office*